United States Patent [19]

Blue

[11] 4,040,125

[45] Aug. 9, 1977

[54] CONVERTIBLE SHIRT COLLAR

[76] Inventor: Sidney D. Blue, 605 Park Ave., New York, N.Y. 10021

[21] Appl. No.: 688,391

[22] Filed: May 20, 1976

[51] Int. Cl.[2] ..... A41B 3/04

[52] U.S. Cl. ..... 2/139

[58] Field of Search ..... 2/116, 146, 131, 129, 2/132, 139

[56] References Cited

U.S. PATENT DOCUMENTS

| | | | |
|---|---|---|---|
| 2,255,362 | 9/1941 | Nirenberg | 2/116 |
| 2,344,204 | 3/1944 | Doumaux | 2/116 |
| 2,423,510 | 7/1947 | Libowitz | 2/131 |

*Primary Examiner*—Werner H. Schroeder
*Assistant Examiner*—Doris L. Troutman
*Attorney, Agent, or Firm*—William R. Liberman

[57] ABSTRACT

A collar attached to an outer shirt folds neatly along one curved line when the shirt is worn with the neckband closed or the ends thereof overlapped, and to fold easily along a second curved line, spaced below the first line, when the shirt is worn with the neckband open so the upper portions of the shirt body adjacent the opening will fold back as lapels to lie flatly and neatly against the front panels of the shirt body; the fold lines being defined, at least in part, by slots in the collar interlining.

6 Claims, 5 Drawing Figures

FIG. 1
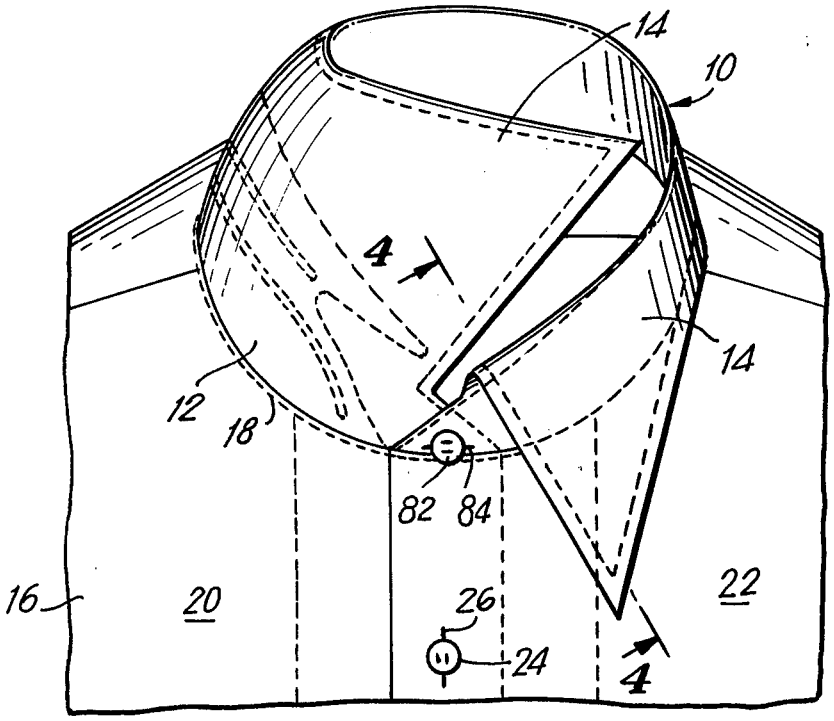
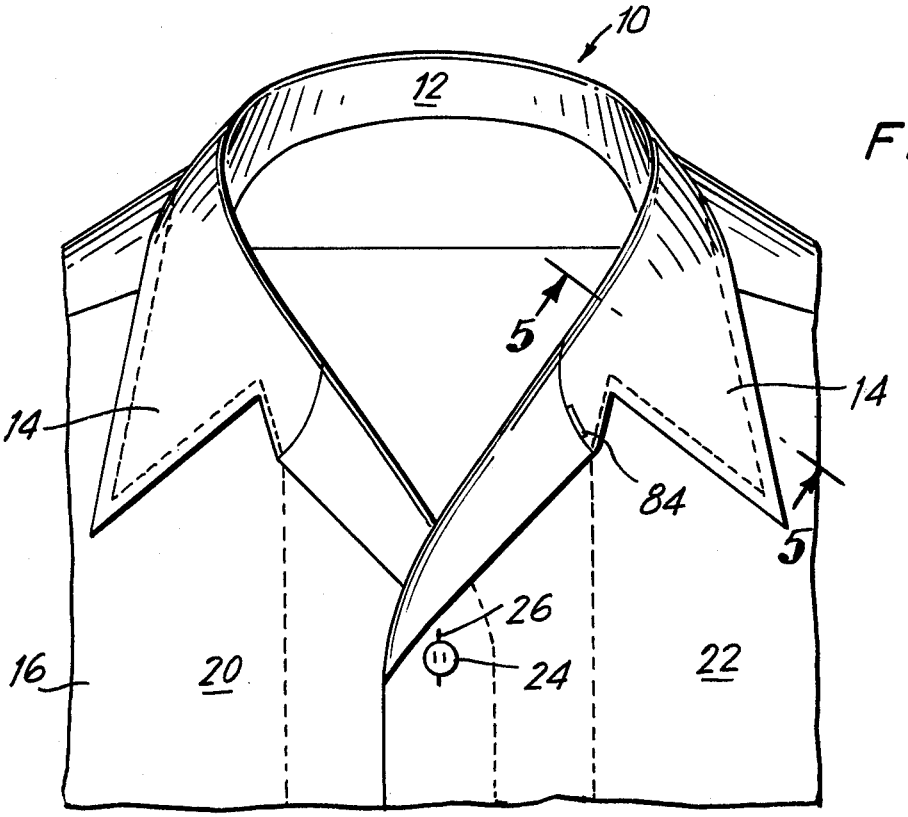
FIG. 2

CONVERTIBLE SHIRT COLLAR

BACKGROUND OF THE INVENTION

The invention relates to an improved construction for collars of the type permanently attached to shirts of the overlapping front panel type. Such collars conventionally include a neckband portion, the lower edge of which is secured to the neck opening of the shirt body, and a top or cape portion secured to or integral with the neckband, which top or cape portion is turned down over the neckband.

Many attempts have been made in the past to provide an outer dress shirt which can be worn also as a sport shirt, as desired. For dress purposes, the ends of the neckband are overlapped and buttoned, or otherwise secured, and the shirt ordinarily worn with a necktie threaded between the neckband and collar cape. In this position, of course, the sides or panels of the shirt body adjacent the front opening lie flatly against the body of the wearer. However, when the shirt is worn with the neckband unfastened, and the upper portions of the front panels immediately adjacent the front opening are turned back to fold over against the shirt body, the results inevitably are unsightly and uncomfortable.

Previous attempts to provide a dual purpose collar have failed to appreciate that the neckband configuration which produces a collar that will fit properly when worn closed and with a necktie will not function properly to serve the same purpose for a collar that is to be worn open for casual wear. The closed collar neckband must ordinarily be of sufficient height at the back so that it will rise above the collar of the wearer's jacket thereby to prevent the jacket collar from rubbing on the wearer's neck. Also, it must have overlapping band ends that stand high enough, in their overlapped position, to accomodate the necktie knot else the knot's bulk will force the wings or point portions of the collar cape to be lifted outwardly and thus create an untidy effect. Also, it must be of sufficient height at the sides to support the cape in an upright position to prevent wrinkling where the cape passes over the shoulders.

The requirements for the neckband of the open collar are quite different. The cape portion of the casual collar must achieve a lower and flatter profile, and the band height must be lower and the cape wider. The cape of the casual collar assumes its best appearance when it splays out from the neck as it crosses over the shoulder and conforms to the slanting plane of the shoulder. To achieve this posture it is necessary that the neckband be constructed so as to provide a reduction in height, from the center of its back portion, in a descending arcuate configuration as it passes over the shoulder so that it comes, approximately, to a zero height when it reaches the chest area. At this point the cape no longer needs the vertical support of the neckband, so the neckband ends are free to roll outward with the turned back edges of the front panels to form a lapel.

It is obvious that a single fold line cannot provide the functional duality required in a convertible collar. Therefore, the present invention has for its main object the provision of a shirt collar having two vertically spaced fold lines wherein the different fold lines will be clearly and positively defined so as effectively to provide two neckband portions, each of a different configuration with the two fold lines residing in the same lining ply.

Prior attempts at solving the problem failed because the constructions thereof did not provide overlapping neckband ends to support the necktie knot, and for other and more obvious reasons. Characteristic of such attempts are the disclosues of such patents as U.S. Pat. Nos. 2255362, 2310899, 2344204, 2345764, 2385729, and 2433522. U.S. Pat. No. 2310899 does provide overlapping neckband ends to support a necktie knot. However, a fold line guide element is provided having a crest acting to retain the back portion of the collar in its upright position when worn with a necktie. This support patch prevents the collar from assuming a lower back profile which is needed to release the collar cape so that the wings will splay outwardly in a relatively flat plane when the collar is worn open. U.S. Pat. No. 2344204 refers to and describes two curved lines, one spaced from the other, but achieves this at the cost of added materials, additional steps in formation, and consequently greatly increased expense. However, even this approach to the problem did not succeed because the fold lines were never sufficiently clearly defined and it was necessary, each time the positions of the collar and shirt front were to be altered from one position to the other, to do so manually in defining the particular fold line desired. Furthermore, without overlapping neckband ends, there is no support at the front of the collar to stabilize the location of the fold line behind the necktie knot.

BRIEF DESCRIPTION OF THE DRAWINGS

In the drawings annexed hereto and forming a part hereof,

FIG. 1 is a front elevational view of a shirt incorporating the collar of the invention with the neckband buttoned and the collar cape folded partially along one fold line, one wing of the collar cape shown folded downwardly over the neckband and lying flatly against the upper portion of the shirt body adjacent the vertical edge of the front panel, and the other wing of the collar cape shown extended upwardly to expose the collar neckband;

FIG. 2 is a front elevational view of the shirt of the present invention with the neckband open and with the collar folded along the second fold line, the collar wings, the end portions of the neckband, and the portions of the front panels neatly folded back and lying flatly over the shirt body;

DESCRIPTION OF THE PREFERRED EMBODIMENT

Figure 3:
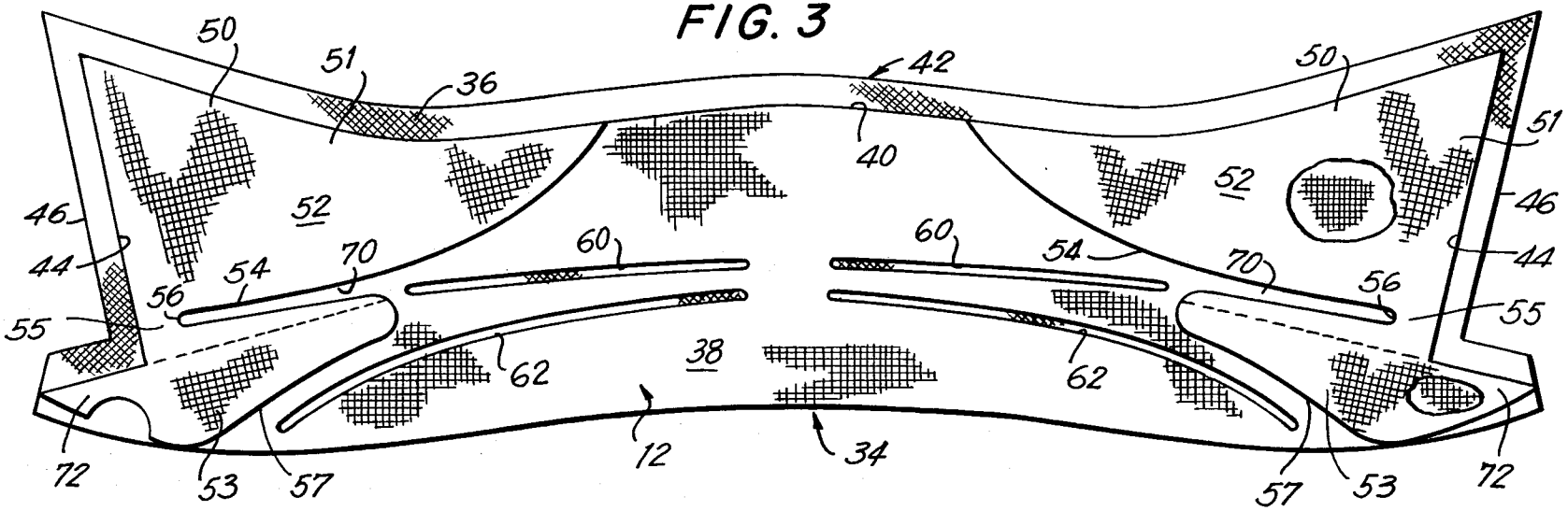
FIG. 3 is a plan view, partly broken away, of the lining component of the collar according to my invention.
Figure 5:
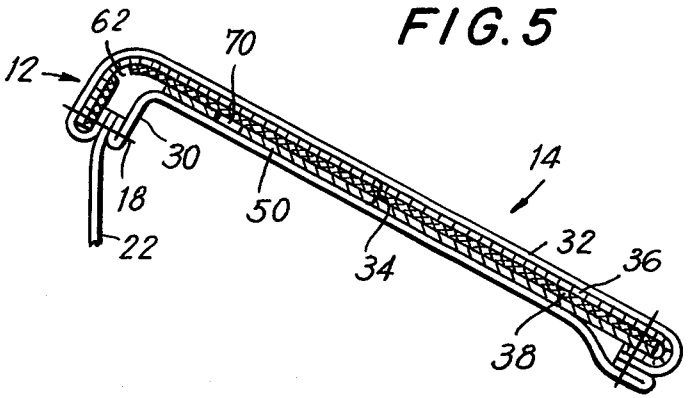
FIG. 5 is a section on the line 5—5 of FIG. 2.
Figure 4:
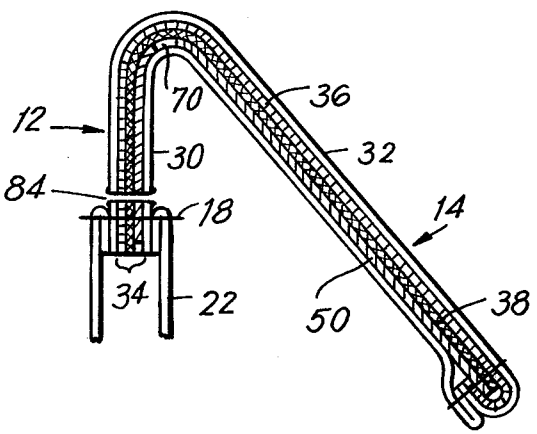
FIG. 4 is a section on the line 4—4 of FIG. 1.

Referring to FIG. 1 of the drawings, collar 10, constructed according to and embodying the present invention, comprises a neckband portion 12 and a cape portion 14 integral therewith. As shown, the lower edge of neckband 12 is sewn to the neck opening of shirt body 16 by a line of stitching 18. The front of the conventional shirt comprises a pair of panels 20, 22 separably attachable along a front center line, the proximating portions of said panels overlapping and secured as by buttons 24 on panel 20 and cooperating button holes 26, on panel 22.

Collar 10 comprises three components, inner and outer facings 30, 32 respectively, and an intermediate liner assembly 34. Liner assembly 34 comprises a number of elements of fusible material coated or treated with such thermoplastic as polyethylene so that, when subjected to heat and pressure, the several overlaid elements fuse together. The main ply 36 of liner assembly 34 is of fusible or non-fusible material shaped to conform to the shape of the collar. Superposed on and fused to ply 36 is a second ply 38 of fusible lining material, the lower edge of which coincides with the lower edge of base layer 36, the upper edge 40 of the second ply 38 being spaced inwardly of the upper edge 42 of the main ply 36, and the sides 44 of ply 38 being spaced from the side marginal edges 46 of main ply 36.

Lining ply 38 has formed therein, usually by die cutting, a pair of upper slots 60, 60 extending laterally from points spaced outwardly from the center of the collar back, said slots reaching approximately half-way the length of the collar to the ends 46, along the line separating neckband 12 from cape 14, said slots 60, 60 defining the fold line of the back half of the collar when the neckband is closed as shown in FIG. 1. A second pair of slots 62, 62 are formed through ply 38 in the neckband portion thereof, similarly extending from points spaced outwardly from the center of the collar back, and curving downwardly and beyond the outer ends of slots 60, 60 to a point short of the lower edge of the neckband 12, the outer ends of each pair of slots 60, 62 being spaced apart a distance considerably greater than the distance between the slots at the back of the collar.

A supporting patch 50, also of suitable fabric, is disposed atop second ply 38 at each end of the collar, the upper edges of the patches coinciding with the upper edge 40 of ply 38, and the side edges coinciding with the side edges 44 of ply 38. Each patch 50 comprises a generally triangular main body portion 52 and a generally triangular smaller sub-body section 53, the two patch sections being connected by an integral strap 55. Main patch section 52 coincides at the top with collar ply 38, and extends from the side edge of each wing to a point short of the midpoint of the collar at the rear thereof, thence curves downwardly and outwardly, as shown at 54 in FIG. 3 to a point 56 short of the side edge of each collar wing where it merges into strap 55.

As seen in FIG. 3, the supporting patch 50 can be roughly likened to two scalene triangles as 51, 53 joined at their shorter sides by the bridging strap 55, the triangles being progressively spaced apart along two confronting sides, as indicated at 70. It will be noted that spacing 70 is in line with upper slots 60, 60, and that the outer ends of lower slots 62, 62 curve and extend below lower triangle 53, following the curve of the lowermost side 57 of the lower triangle, and spaced therefrom. Upper supporting triangle 51 is disposed within the cape portion of the collar and lower supporting triangle 53 is disposed wholly within the neckband portion of the collar, each lower triangle 53 being provided with an outwardly shouldered extension 72 to just short of the ends of the neckband. Generally speaking, supporting triangular patches 51, 53 are somewhat akin to the same elements 40, 50, respectively, shown in my prior U.S. Pat. No. 3,629,866, serving the same supporting purposes. After the collar is put together in final form in accordance with conventional procedures, entire liner assembly 34 is disposed between face plies as 42, and patch 50 will be adjacent the underfacing of the cape.

When the ends of neckband 12 are secured together as by button 82 at one end of the neckband engaging buttonhole 84 at the other end and the cape portion 14 of the collar is folded downwardly over neckband portion 12, it will break automatically along the line 60, 60, 70, providing a neat continuous fold line as shown in FIG. 1 of the patent. When it is desired that the shirt be worn open at the neck, as a sport shirt or casual shirt, the ends of neckband 12 are separated and the collar wing and neckband folded over on the line below that of slots 60 along the lines defined by slots 62, 62. The arcuate fold line thus provided terminates at a distance from the juncture of the ends of the neckband portion 12 and the related vertical edges of the shirt front panels 20, 22, thus permitting the upper portion of the edges of the shirt front to fold outwardly in a graceful roll which, in combination with the corresponding movement of the related ends of the neckband portion 12, form attractive lapels which are further enhanced in appearance by the arcuate outward sweep of the bottom edges of the ends of the neckband portion 12 at the neck opening of the shirt body 16.

I claim:

1. A collar for attachment to the neck opening of a shirt body of the type having front body panels with central overlapping vertical edges, the collar including a first outer cape portion and a neckband portion and a second cape portion and neckband portion on the underside of the collar, a multi-ply interlining disposed and secured between the outer and under cape and neckband portions, a first pair of upper slots through one ply of the lining extending laterally outwardly from spaced points at the back of the collar along a line demarking the collar cape from the neckband, the outer ends of the first pair of slots being spaced from the ends of the collar, a second pair of slots through the same ply of the collar interlining extending outwardly similarly spaced from points at the back of the collar, said second pair of slots extending laterally of the collar and curving downwardly across the neckband terminating short of the bottom of the neckband and at a lateral distance beyond the outer ends of the first pair of slots.

2. The collar of claim 1, wherein the distance between the first and second pairs of slots gradually increases from the back of the collar towards the ends thereof.

3. The collar of claim 1, wherein the slots of the second pair are formed wholly within the neckband portion of the collar interlining.

4. The collar of claim 1, wherein the length of the slots of the first pair is approximately half the length of the collar from side to side thereof.

5. The collar of claim 1 including, as part of the interlining along the ends of the collar, supporting patches secured to the slotted collar ply, one portion of the patch being coextensive with the collar cape at the ends thereof, a second portion of the patch, spaced at least in part from the first portion thereof being coextensive with the collar neckband at the ends thereof, the spaces between the patch portions being aligned with the slots of the first pair thereof.

6. The collar of claim 5, wherein the two portions of the patch are of generally scalene triangular shape, at least one side of each thereof being straight.

* * * * *